United States Patent [19]

Eitzen et al.

[11] 4,061,315

[45] Dec. 6, 1977

[54] ORBITAL PLATFORM STIRRING SYSTEM

[75] Inventors: Vincent Elliott Eitzen, Evanston; Robert Rockwell Moore, Glenview, both of Ill.

[73] Assignee: American Hospital Supply Corporation, Evanston, Ill.

[21] Appl. No.: 696,735

[22] Filed: June 16, 1976

[51] Int. Cl.[2] ..... B01F 11/00

[52] U.S. Cl. ..... 366/111; 74/86; 209/366; 366/142; 366/208

[58] Field of Search ..... 259/91, 72, 54, 29, 259/12, 2, 56, 57, 75, DIG. 42; 51/6, 7, 170 MT; 74/86; 209/366

[56] References Cited

U.S. PATENT DOCUMENTS

| | | | |
|---|---|---|---|
| 2,970,235 | 1/1961 | Pike | 259/72 |
| 3,159,384 | 12/1964 | Davis | 259/72 |
| 3,163,966 | 1/1965 | Moore | 259/72 |
| 3,184,222 | 5/1965 | Aronowitz | 259/54 |
| 3,286,939 | 11/1966 | Karpenko | 259/54 |

*Primary Examiner*—Robert W. Jenkins

*Attorney, Agent, or Firm*—Tilton, Fallon, Lungmus & Chestnut

[57] ABSTRACT

A platform or tray for holding laboratory containers such as test tubes is driven in orbital motion by an eccentric drive mechanism housed in a cabinet. First and second pairs of tracks are mounted respectively beneath the tray and to the top of the cabinet. An intermediate plate holds four disc-shaped, low-friction bearing elements, each coupled to and guided by an upper and a lower track to maintain said tray in the same disposition during its orbital motion. An electronic circuit controls orbital speed in a continuous manner over the operating range, even at low speeds. The system operates in either a continuous mode or timed mode under control of a switch. The motor which drives the platform also drives a dc motor, the terminal voltage of which is displayed as a signal representing the speed of operation. Both the speed and the time (in timed mode of operation) may be controlled by the operator. A vibration-free mounting system is used to secure the main motor and drive train within the cabinet.

17 Claims, 6 Drawing Figures

Fig. 1
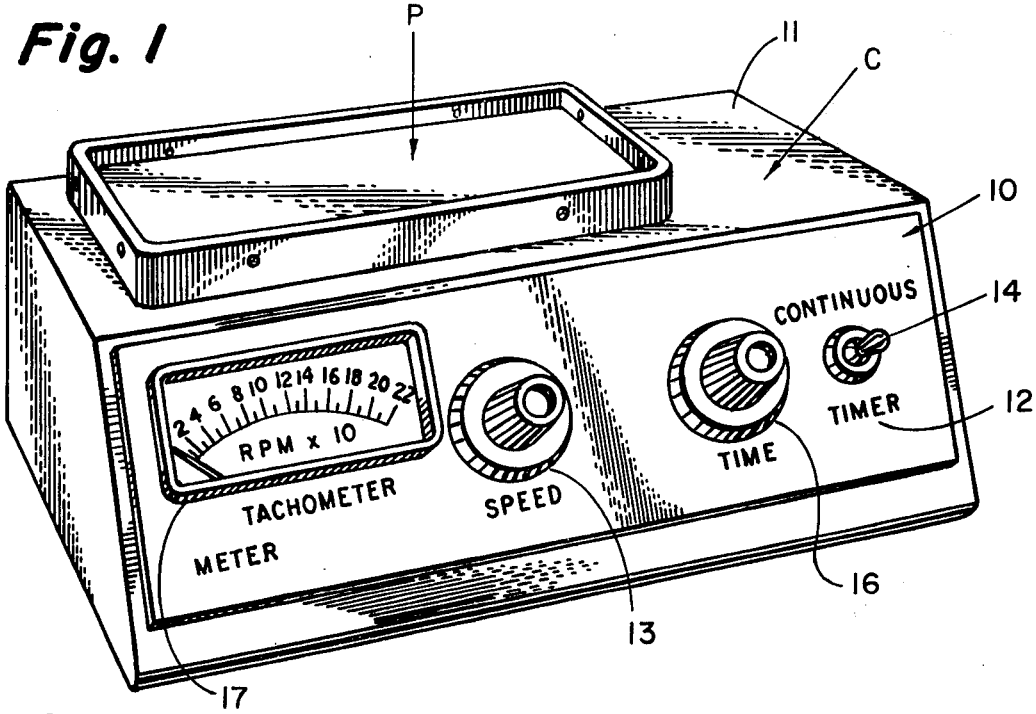
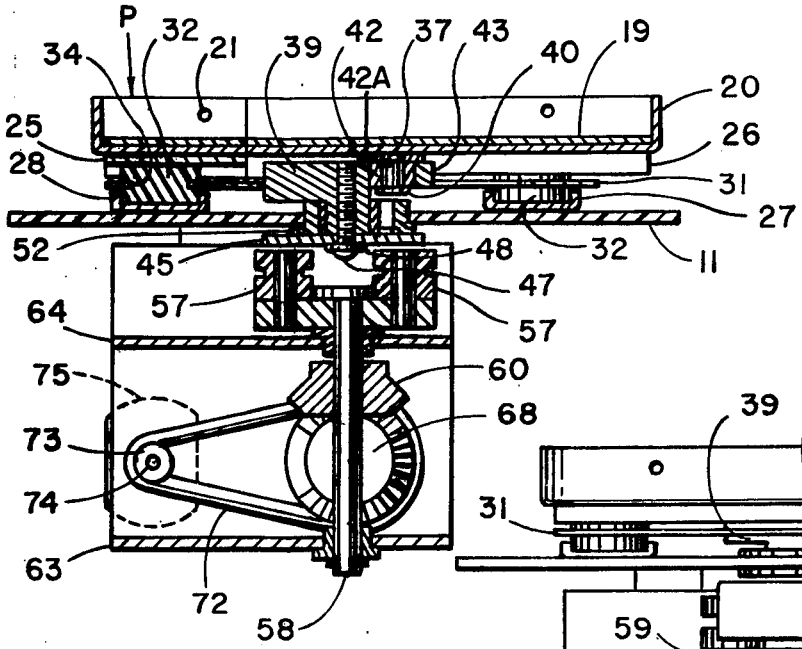
Fig. 4
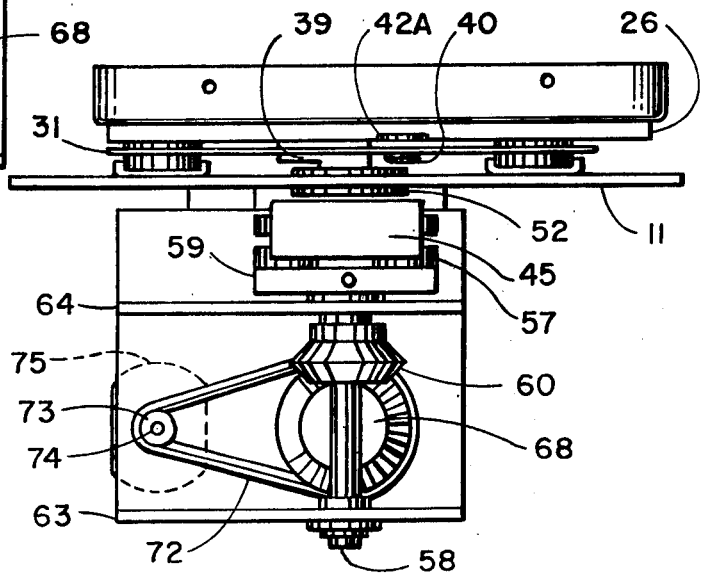
Fig. 5

ORBITAL PLATFORM STIRRING SYSTEM

BACKGROUND AND SUMMARY

The present invention relates to mixing apparatus of the type used in laboratories. Such equipment, as a laboratory instrument, may have a wide range of uses, from general stirring applications to those with more exacting requirements such as aliquot mixings, extraction procedures and reagent preparation.

In stirring or mixing applications of this type, it is noted that the plate or tray on which the containers or holders are supported is not rotated in the true sense of the word—rather, the center of the plate, and all other points on the plate, are driven in small circles so that any given line on the plate remains parallel to the same line during the entire orbital motion. The orbit may be circular, or it may be elliptical. Orbiting stirring devices of this type are known in the art, and the following patents are representative of the state of the art: U.S. Pat. Nos. 681,254; 2,828,949; 2,976,792; 3,184,222; and 3,396,947.

According to the present invention, a platform or tray for holding laboratory containers such as test tubes or the like is driven in orbital motion by an eccentric drive mechanism housed in a cabinet. A first pair of parallel tracks of inverted channel shape, is secured to the bottom of the platform, and a second pair of parallel tracks, also of channel shape, is mounted to the top of the cabinet. The first and second pairs of tracks extend transverse of each other.

Between the two pairs of tracks is an intermediate plate having a large central aperture so that the drive shaft for the platform can rotate is located between the two pairs of tracks. Four disc-shaped bearing elements are mounted to the intermediate plate, extending to either side thereof, in the form of a square. Each bearing element is received in and coupled to an upper and a lower track to maintain the platform in the same disposition during its orbital motion.

The motor and drive train which actuates the platform are housed in the cabinet, and they are mounted with shockproof of vibration-free elements so as to minimize operating noise.

The system operates in either a continuous mode or a timed mode under control of a switch. In the timed mode, the operator determines the time of operation by setting a knob.

The main drive motor which actuates the platform also drives a small dc motor which acts as a tachometer. The terminal voltage of the tachometer motor is displayed as a signal representing the revolutions per minute of the platform. The speed of operation may also be set by the operator, by adjusting a knob which controls an electronic control system. The speed of operation is variable in a continuous linear manner within the design range.

A thin layer of sponge runner is provided on the upper surface of the platform to prevent laboratory ware from creeping off the platform during operation. The platform is provided with a raised outer rim so that slides may be placed on the platform and will not be thrown off at high speeds. Holes are provided in the rim for securing containers to the platform during high-speed operation.

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 1 is a perspective view of an instrument constructed according to the present invention;

FIG. 4 is a cross sectional view taken through the sight line 4—4 of FIG. 3;

FIG. 5 is a left side view of the interior of the instrument of FIG. 1 partially broken away to show the tachometer motor.

DETAILED DESCRIPTION

Figure 2:
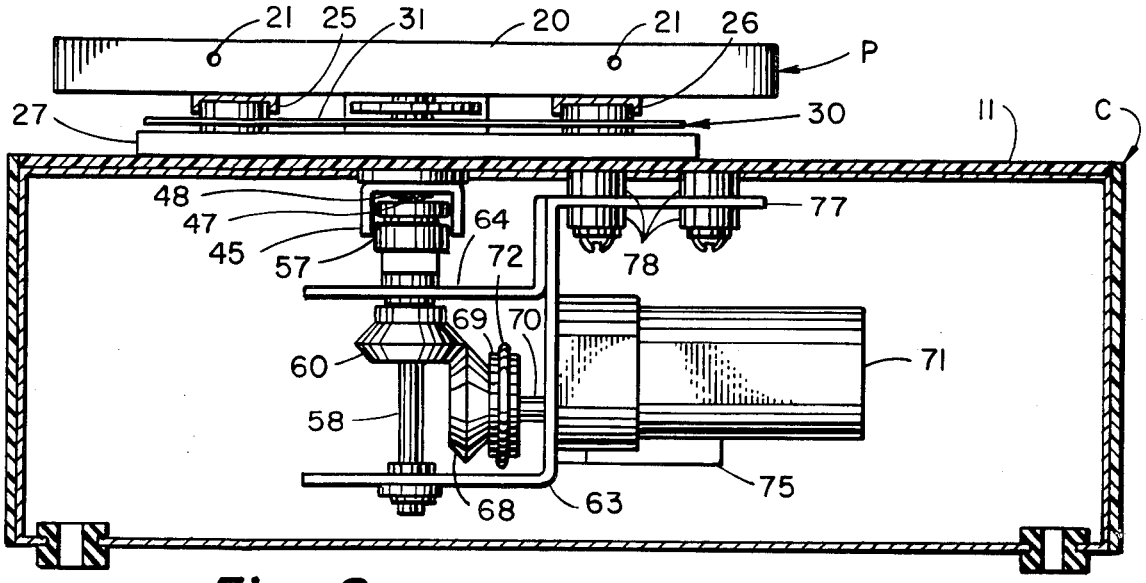
FIG. 2 is a vertical cross sectional view, taken from the front, of the instrument of FIG. 1.

Referring first to FIG. 1, a complete instrument constructed according to the present invention is shown (except for the electrical cord which plugs into a conventional wall socket) and generally designated by reference numberal 10. The instrument includes a cabinet C, on top of which is located a platform or tray P.

The cabinet C includes a top panel 11, and an inclined control panel 12. The control panel 12 supports a first knob 13 for controlling the speed at which the platform P is orbited (in revolutions per minute), and a switch 14 which determines whether the instrument operates in a continuous mode or a timer mode. In the timer mode of operation, the amount of time is set by a second knob 16. The orbiting speed of the platform P is measured and displayed on the meter 17.

The platform or tray P has a rubber mat 19 (see FIG. 4) for holding slides or other laboratory ware being orbited. The rubber mat 19 provides a high friction surface. The platform P also includes four upturned sides 20 which prevent the slides from being thrown from the platform during operation. Further, the sides 20 have holes 21 so that flasks, beakers, bottles, etc. may be tied to the platform during operation.

Figure 3:
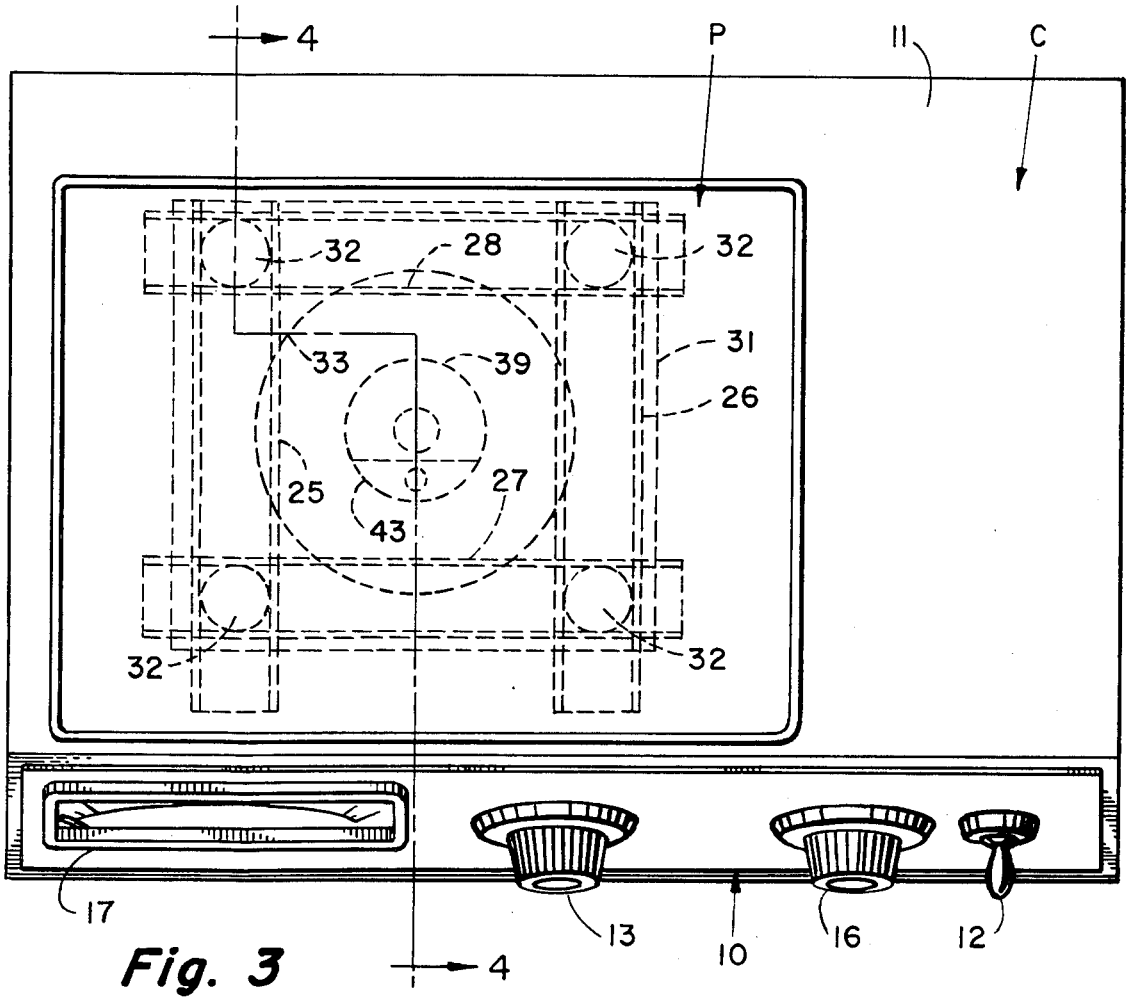
FIG. 3 is a plan view of the instrument of FIG. 1, with certain of the operating elements shown in phantom.

Secured to the bottom of the platform P are a pair of elongated bearing tracks 25 and 26, of inverted channel shape. The tracks 25, 26 are spaced apart and parallel to each other (FIG. 3). Transverse of the bearing tracks 25, 26 are a second pair of such tracks, designated respectively 27 and 28. The tracks 27, 28 are secured to the top panel 11 of the cabinet or housing C. These are also of channel-shape, but face upwardly.

Located between the upper and lower pairs of tracks is a bearing assembly generally designated by reference numeral 30 and including a horizontal intermediate plate 31, seen in FIGS. 2-5. Referring now to FIG. 3, mounted at the four corners of the intermediate plate 31 are disc-shaped slide bearings designated 32. The center of the plate 31 is provided with an enlarged opening 33, as will be discussed. The upper portions of the slide bearings 32 are received in the tracks 25, 26, and the lower portions are received in the tracks 27, 28. Referring to FIG. 4, it will be observed that there are peripheral grooves 34 in the slide bearings 32 into which the intermediate plate 31 is received in a snap fit. The peripheral grooves 34 are deep enough that the slide bearings are freely rotatably within the intermediate plate 31 thereby to further reduce friction.

The bearings 32 are preferably made of a low friction material such as the manufactured and sold under the mark Teflon.

The function of the intermediate plate 31 is to act as a frame to maintain the bearings in fixed relation to each other so that when the platform P is driven, its orbital motion is smooth. That is, because of the tolerances between the slide bearings and their associated tracks, there would be a degree of movement but for the intermediate plate 31. The central opening 33 in FIG. 3 permits the cam and drive shaft (to be discussed presently) to extend upwardly to drive the platform from the drive motor which is housed within the cabinet C.

Referring now to FIG. 4, platform P is driven by a drive shaft 37 extending from the bottom of the platform. The shaft 37 is eccentrically mounted to a drive cam 39. The drive shaft 37 is a pin which is staked into the bottom of the platform, and secured to the cam 39 by means of a retainer ring 40. A drive cam bearing 42 is interposed between the cam 39 and the shaft 37. A low friction thrust washer 42A is located between the bearing 42 and the bottom surface of the platform P.

As best seen in FIG. 4, one portion 43 of the cam 39 is reduced so as to permit mounting of the drive pin. The cam, in turn, is mounted to a coupler 45 seen best in FIG. 2 as having an inverted channel shape. The coupler 45 is moutned by means of a machine screw 47 and a lock washer 48 to the cam 39.

A platform bearing generally designated by reference numerals 52 is pressed into the top panel 11 of the housing C and receives the hub of the drive cam 39 (FIG. 4). The coupler 8 receives two spaced grommets designated 57 in FIG. 4. The grommets 57 (of resilient material such as plastic or rubber to cushion vibration) are secured to a drive coupler base designated 59 in FIG. 5 which is secured to a gear shaft (see 58 in FIGS. 2 and 5). The gear shaft 58 is provided with a first beveled gear 60, which is mounted between a motor bracket 63 and a gear support bracket 64. A second bevel gear 68 and a pulley 69 are mounted to a motor shaft 70 of motor 71 which, in turn, is secured to the motor support bracket 63.

Referring now to FIG. 4, the pulley 69 has trained about it an O-ring drive belt 72 which is also trained about a pulley 73 connected to a drive shaft 74 of a small DC electric motor 75 being used as a generator—that is, the motor 75 is actually a load on the main drive motor 71; and at the terminals of the motor 75 there is generated a DC potential which is representative of the speed of the motor 75, and hence the speed of the drive motor 71. It is this voltage which is displayed on the tachometer meter 17 on the faceplate panel 12.

Returning now to FIG. 2 it will be observed that the motor support bracket 63 has an upper horizontal flange 77 which is mounted by means of four grommets 78 to the bottom surface of the top panel 11. By means of these grommets 78 and the earlier-described grommets 57 (all of which are made of resilient, vibration-isolating material such as gum rubber), there is total mechanical isolation between the cabinet C and platform P on one hand, and the motor and drive assembly on the other hand. This greatly reduces noise from the motor 71 which would otherwise be transmitted to the walls of the cabinet which could act in the nature of diaphragms to transmit noise.

Figure 6:
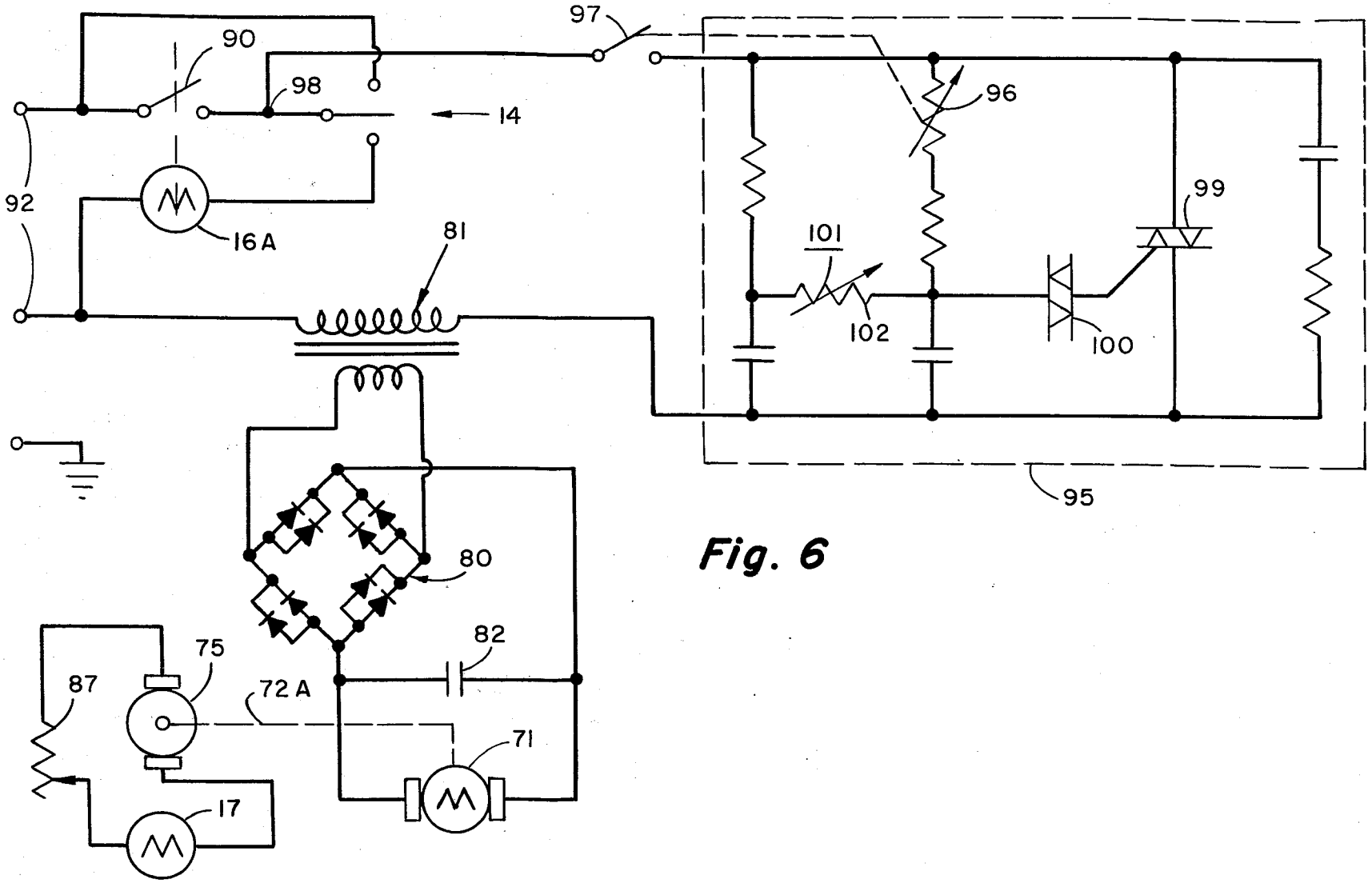
FIG. 6 is a circuit schematic diagram, partly in functional block form, of the electronic control system for the instrument of FIG. 1.

Turning now to the circuit schematic diagram of FIG. 6 the main drive motor 71 is represented diagrammatically. This motor is a low voltage DC motor which is energized from a rectifier bridge 80 which is, in turn, fed from the secondary winding of a tranformer 81. A capacitor 82 is connected across the output terminals of the bridge circuit 80 to reduce ripple. As illustrated in the lower portion of the drawing, the motor 71 drives the tachometer motor, previously described and designated by reference numeral 75, the drive being diagrammatically represented by the dashed line 72A. The output terminals of the tachometer motor 75 are connected in series with a variable resistor 87 and the previously described meter 17 which is on the front panel of the cabinet C. The meter 17 may be a 0–1 milliamp meter. Variable resistor 87 is used to calibrate the motor 75 (used as a generator) to the meter 17.

Referring now to the upper portion of FIG. 6, the previously described switch 14 is shown as a single pole, double throw switch. It is switched between a "continuous" operation and a "timed" operation as illustrated. The movable contact 14A of switch 14 is connected in series with a snap switch 90, shown in the open position and driven by a timer motor 16A which, in turn, is set by the knob 16 on the faceplate panel of the cabinet C. When the switch 14 is in the "timed" position, and the timer rotated by hand, the snap switch 90 closes, so that power is fed from the input terminals 92 through the closed switch 90 to energize the timer motor 16A and to the input of speed control circuitry, enclosed within dashed block 95. When the timer motor 16A times out, the snap switch 90 is opened by the timer, and the power is shut off from the speed control circuitry 95 and the timer motor 16A.

Turning now to the speed control circuitry 95, it includes a variable resistor 96, the shaft of which actuates a switch 97. The other terminal of switch 97 is connected to junction 98 between the snap-switch 90 and movable contact of toggle switch 14. The speed control circuit includes a triac 99, in the gate circuit of which there is a diac 100. A bias network 101 determines the phase angle at which the triac 99 will conduct in each cycle of the AC input voltage. Adjustment of the variable resistor 96 further adjusts the firing phase angle. This adjustment varies the conduction angle of the output voltage from the speed control circuit 95 which is fed to the primary winding of the transformer 81. Thus, the output voltage of the bridge 80 is also adjusted to change the speed of drive motor 71. A variable resistor 102 the bias network 101 provides a set-up adjustment for speed control.

Having thus described in detail a preferred embodiment of the invention, persons skilled in the art will be able to modify certain of the structure which has been illustrated and to substitute equivalent elements for those disclosed while continuing to practice the principle of the invention; and it is therefore intended that all such modifications and substitutions be covered as they are embraced within the spirit and scope of the appended claims.

We claim:

1. Stirring or vibrating apparatus comprising: a cabinet having a top panel; platform means above said cabinet for holding members; drive means for moving said platform in orbital motion in a horizontal plane; and bearing means for maintaining said platform in fixed orientation throughout its orbital motion, including a first pair of parallel track means on said platform, a second pair of parallel track means on said cabinet extending transverse of and beneath said first pair, and rigid frame means between said first and second pairs of track means, said frame means including bearing means for interconnecting said track means at location where said first pair of track means overlie said second pair of track means.

2. The apparatus of claim 1 wherein said drive means comprises a cam having a vertical axis; a pin pivotally mounted to said cam at a location offset from said vertical axis and fastened at its upper end to said platform; a drive motor within said cabinet; the shaft driven by said motor; and coupling means for coupling said drive shaft to drive said cam about said vertical axis.

3. The apparatus of claim 2 wherein said coupling means comprises a pair of spaced resilient elements connected to one of said cam and said drive shaft; and a coupler engaging said resilient elements and connected to the other of said cam and said drive shaft.

4. The apparatus of claim 1 wherein said first and second pairs of parallel tracks comprise channel-shaped elongated members, and wherein said bearing means comprise four disc-shaped low-friction plastic elements, each received in one of said first pair of track means and one of said second pair of track means.

5. The apparatus of claim 4 wherein each of said bearing discs is made of a low-friction plastic material and has a central peripheral groove, said frame means comprising a metal plate apertured to receive said discs such that the centers of said disc define a square, the grooves in said disc being sufficient to enable the turning of said disc within said plate.

6. An apparatus for stirring or vibrating a platform connected to an eccentric drive means, the combination comprising: means providing a horizontal surface beneath said platform; a first pair of parallel tracks of inverted channel shape mounted to the bottom of said platform; a second pair of parallel tracks of upright channel shape mounted to said horizontal surface and extending transverse of and beneath said first pair of track; four disc-shaped bearing elements, each coupled to one of said first pair of tracks and one of said second pair of tracks; and frame means rigidly coupling said bearing elements together.

7. The apparatus of claim 6 wherein said frame means comprises a flat plate having four apertures, the centers of which define a square, each aperture adapted to receive one of said disc-shaped bearing elements, each bearing element having a peripheral groove and press-fitted into said plate, the diameter of said groove in each bearing element being slightly less than the diameter of its associated aperture in said plate, whereby each bearing element may be freely rotated within its associated aperture.

8. The apparatus of claim 6 wherein the channel shape of each of said tracks is a general U-shape, and wherein said first pair of tracks are spaced at a distance approximately equal to the spacing of said second pair of tracks.

9. Stirring or vibrating apparatus comprising: a cabinet having a top panel; platform means on and above said cabinet for holding members; drive means, including a cam eccentrically connected beneath said platform for orbiting the same; bracket means within said cabinet; vibration-resistant mounting means for securing said bracket within said cabinet; a shaft; a drive motor mounted to said bracket means and coupled to said shaft to rotate the same; vibration-resistant coupler means for coupling said shaft to said cam, including a pair of laterally spaced resilient members connected to one of said shaft and cam and a channel shaped coupler straddling said resilient members and connected to the other of said shaft and cam whereby said cabinet and said platform are substantially free of noise transmission from said motor.

10. The apparatus of claim 9 wherein said platform includes an upturned peripheral rim for holding members placed on said platform.

11. The apparatus of claim 10 wherein said rims are provided with a plurality of apertures for tying containers placed on said platform during said orbital motion.

12. The apparatus of claim 9 wherein said platform is provided with a high-friction rubber mat for holding things placed on said platform.

13. The apparatus of claim 9 wherein said cam is rotated by said coupling means about a peripheral axis and includes a pin mounted for rotation about a vertical axis spaced from the axis of rotation of said cam, the upper portion of said pin being secured to the bottom of said platform.

14. The apparatus of claim 9 wherein said bracket means comprises first and second vertically spaced horizontallyextending plate members, said shaft extending through said plate members; and first and second bearing members for mounting said shaft to said first and second plate members respectively.

15. The apparatus of claim 9 further comprising a tachometer motor; means for driving said tachometer motor from said drive motor; and meter means for displaying the voltage generated by said tachometer motor as a representation of speed of orbital motion of said platform.

16. An apparatus for stirring or vibrating a platform connected to eccentric drive means, the combination comprising: a direct current drive motor; eccentric drive means coupling the output of said drive motor to said platform; a first switch having a first position for continuous mode operation and a second position for timed mode operation; speed control circuit means including a variable phase angle trigger circuit and adjustable by an operator to vary the phase angle of an input alternating voltage; rectifier means responsive to the triggered input alternating voltage for generating a DC voltage representative thereof and for coupling the same to said drive motor; and timer motor means including a second switch connected in circuit with said first switch and said speed control circuit means, whereby when said first switch is placed in said timed mode operation and said timer motor actuated, said timer mode will open said second switch when the present time runs out to interrupt said speed control circuit means, said second switch being operative in said continuous mode position to continuously energize said speed control circuit means irrespective of the position of said second switch.

17. The apparatus of claim 16 further comprising a DC tachometer motor mechanically driven by said drive motor and generating a terminal voltage representative of the drive speed; a meter for displaying said terminal voltage of said tachometer motor; and variable resistor means connected in circuit with said tachometer motor and said meter for calibrating said meter.

* * * * *